United States Patent [19]

Choi

[11] Patent Number: 4,853,147

[45] **Date of Patent: * Aug. 1, 1989**

[54] LIQUID DISHWASHING DETERGENT COMPOSITION FOR IMPROVED HAND WASHING OF DISHES IN COLD WATER

[75] Inventor: Sunhee Choi, Annandale, N.J.

[73] Assignee: Colgate-Palmolive Company, Piscataway, N.J.

[ * ] Notice: The portion of the term of this patent subsequent to Feb. 16, 2005 has been disclaimed.

[21] Appl. No.: 121,182

[22] Filed: Nov. 16, 1987

Related U.S. Application Data

[63] Continuation of Ser. No. 798,530, Nov. 15, 1985, Pat. No. 4,725,377.

[51] Int. Cl.[4] ..... C11D 1/04

[52] U.S. Cl. ..... 252/174.19; 252/135; 252/173; 252/174.21; 252/528; 252/547; 252/DIG. 14

[58] Field of Search ..... 252/135, 528, 547, 173, 252/174.19, 174.21, DIG. 14

[56] References Cited

U.S. PATENT DOCUMENTS

| | | | |
|---|---|---|---|
| 3,956,161 | 5/1976 | Woodward | 252/DIG. 14 |
| 4,065,409 | 12/1977 | Flanagan | 252/528 |
| 4,259,217 | 3/1981 | Murphy | 252/547 |

OTHER PUBLICATIONS

Industrial Utilization of $C_{21}$ Dicarboxylic Acid, Ward, Jr. et al., vol. 52, J.A.O.C.S., pp. 219–224 (1975).

Hydrotropic Function of a Fatty Dicarboxylic Acid, Flaim et al, 20 Tenside Detergents, No. 4, pp. 177–180 (1983).

*Primary Examiner*—Paul R. Michl
*Assistant Examiner*—Hoa Van Le
*Attorney, Agent, or Firm*—Richard J. Ancel; Robert C. Sullivan; Murray M. Grill

[57] ABSTRACT

A liquid dishwashing detergent composition for hand washing of dishes in cold water includes a synthetic organic nonionic detergent, a cationic surface active agent, a water soluble $C_{21}$ dicarboxylic salt and an aqueous medium. The proportion of the combination of nonionic detergent and cationic surface active agent is a detersive proportion, useful to remove fatty deposits on dishes, and the proportion of the $C_{21}$ dicarboxylic salt is sufficient to improve the detersive action in cold water of the combination of nonionic detergent and cationic surfactant so that the composition better removes fatty deposits on dishes being washed. Preferably, the liquid dishwashing detergent composition comprises 10 to 20% of a nonionic detergent, which is a condensation product of 3 to 20 moles of ethylene oxide with one mole of higher fatty alcohol of 10 to 16 carbon atoms per mole, 10 to 20% of

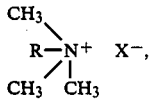

wherein R is a hydrocarbyl chain of 8 to 22 carbon atoms and X is a halogen selected from the group consisting of chlorine and bromine, 1 to 5% of a salt of $C_{21}$ dicarboxylic acid, selected from the group consisting of sodium, potassium, ammonium and triethanolamine salts, and mixtures thereof, and 50 to 80% of water.

Also within the invention is a process for washing dishes in which the mentioned detergent compositions or their components are employed in a cold wash water. Such a process is energy conserving, allowing the washing of dishes, even those containing solid fatty deposits, in facilities where hot water is not available. Additionally, such hand dishwashing may be kinder to the housewife's hands.

11 Claims, No Drawings

LIQUID DISHWASHING DETERGENT COMPOSITION FOR IMPROVED HAND WASHING OF DISHES IN COLD WATER

This is a continuation of application Ser. No. 798,530 filed Nov. 15, 1985 now U.S. Pat. No. 4,725,377.

This invention relates to detergent compositions. More particularly, it relates to a liquid dishwashing detergent composition, useful for hand washing (as distinguished from machine washing) of dishes in cold water, and for effectively removing fatty deposits from such dishes despite the fact that the dishwater is at a temperature lower than that which is usually considered to be necessary for effective removal of fatty materials from the dishes.

Dishwashing detergents, useful for hand dishwashing (and not irritating to the hands), have been invented and have been perfected so that small proportions thereof are sufficient to wash ordinary dirty dishes efficiently. Adjuvants, such as lower alkanolamides and amine oxides, have been employed in such compositions to improve foaming activity and detergency. Yet, despite the fact that such liquid dishwashing compositions had been found to be effective in hot water, they have been found to be unsatisfactory for cold water dishwashing. Especially difficult is the cold water washing of dishes on which there are deposits of normally solid fatty materials, such as hamburger grease and beef fat. Consequently, the present invention, which allows effective cold water washing of dishes containing deposits of such solid fats, represents a significant breakthrough in detergent research.

The prior art discloses a synergistic detergency of nonionic and cationic surface active agents, especially when used for the washing of laundry, which is to be effected at room temperature or lower. Such synergism is described in an article by Rubingh et al. in 1982 Ind. Eng. Chem. Prod. Res. Dev. No. 21, at pages 176–182. U.S. Pat. Nos. 4,222,905 and 4,259,217 describe heavy duty detergent compositions comprising nonionic and cationic surfactants and mention that the detergent compositions thereof are unusually effective in removing greasy and oily soils, including body soil, from fabrics, and are also effective in removing particulate soils. $C_{21}$ dicarboxylic acid, which is available from Westvaco Corporation as DIACID® 1550, has been described as possessing hydrotropic properties,and was said to have been used as its soluble salts in certain detergents for its hydrotropic or solubilizing effect on them, which detergents would otherwise have been less soluble than required. In articles entitled *Industrial Utilization of $C_{21}$ Dicarboxylic Acid,* published at Vol. 52, J.A.O.0114 C.S. 219–224 (1975), and *Hydrotropic Function of a Fatty Dicarboxylic Acid,* at 20 Tenside Detergents, No. 4 (1983), 177–180, the solubilizing effect of $C_{21}$ dicarboxylic acid salts is mentioned. In those articles it was reported that such $C_{21}$ diacid salts are unique in the degree of water solubility they possess, and that they are capable of assisting in greatly solubilizing other substances into aqueous systems in which such substances are normally quite insoluble. The same articles mention that the $C_{21}$ dicarboxylic salts supplement the activity of the other substance so that less is required to achieve the desired results. U.S. Pat. No. 3,956,161 teaches using $C_{21}$ dicarboxylic acid salts as hydrotropes or solubilizing agents in combination with nonionics to form biodegradable and non-toxic cleaning compositions.

The prior art teaches that the presence of cationic surfactant with nonionic detergent synergistically improves the detergency of the nonionic, and that $C_{21}$ dicarboxylic salt can act as a hydrotrope and as a solubilizing agent for various materials, including nonionic surface active agents. Applicant does not believe that $C_{21}$ dicarboxylic salt acts as a hydrotrope in the systems of this invention. Applicant has found that when $C_{21}$ dicarboxylic salt is added to a nonionic detergent, without any cationic surfactant being present, it does not increase the detergency of the nonionic, and when too much dicarboxylic salt is added to cationic and nonionic mixtures of detergents cleaning action is reduced. One who knew such facts would have found it surprising that when the $C_{21}$ dicarboxylic salt is added to a detersive mixture of nonionic detergent and cationic surface active agents, and the $C_{21}$ dicarboxylic salt concentration is kept relatively low, significant improvement in detergency is obtainable, especially for the removal of fatty deposits from hard surfaces at low wash water temperatures. Accordingly, the present invention is unobvious from the prior art and from knowledge of the lack of favorable effect of the $C_{21}$ dicarboxylic salt on the nonionic detergent. Additionally, when too much $C_{21}$ diacid salt is present, e.g., as much $C_{21}$ diacid salt as detergent (nonionic +cationic), fat removal and other cleaning activities may be decreased. Therefore, it will often be desirable for the contents of $C_{21}$ diacid salts in the invented compositions and in the dishwaters of the invented processes to be less than the sums of the contents of nonionic detergent and cationic surface active agent present.

In accordance with the present invention a liquid dishwashing detergent composition for hand washing of dishes in cold water comprises a synthetic organic nonionic detergent, a cationic surface active agent, a water soluble $C_{21}$ dicarboxylic salt and an aqueous medium, with proportions of the first three such components being such that of the combination of nonionic detergent and cationic surface active agent is a detersive proportion for fatty deposits on dishes and that of the $C_{21}$ dicarboxylic salt is sufficient to improve the detersive action in cold water of the combination of nonionic detergent and cationic surfactant with respect to fatty deposits on dishes being washed. Preferred liquid dishwashing detergent compositions comprise 10 to 20% of nonionic detergent, which is a condensation product of 3 to 20 moles of ethylene oxide with one mole of higher fatty alcohol of 11 to 16 carbon atoms per mole, 10 to 20% of

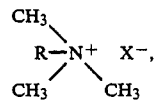

wherein R is a hydrocarbyl chain of 8 to 22 carbon atoms, and X is a halogen selected from the group consisting of chlorine and bromine, 1 to 5% of salt of $C_{21}$ diacid, selected from the group consisting of sodium, potassium, ammonium and triethanolamine salts, and mixtures thereof, and 50 to 80% of water. Also within the invention is a process for washing dishes (and also cooking utensils)in dishwater in which there is preferably present 0.05to 0.5% of synthetic organic nonionic detergent, 0.05 to 0.5 of cationic surface active agent, and 0.005 to 0.05% of a water soluble $C_{21}$ dicarboxylic salt, with the nonionic detergent and cationic surface active agent being present in a combined proportion which is detersive for fatty deposits on dishes, and the $C_{21}$ dicarboxylic salt being present in a proportion sufficient to improve the detersive action in cold water of the combination of nonionic detergent and cationic surfactant with respect to fatty deposits on dishes being washed.

The nonionic detergents employed in the practice of this invention are condensation products of lower alkylene oxide with hydroxy-containing lipophiles. Normally, the lower alkylene oxide will be ethylene oxide and the detergents will be made by condensation of ethylene oxide with a lipophile-containing compound, such as a higher fatty or linear alcohol of 10 to 18, preferably 10 to 16, and more preferably 10 to 13, e.g., 10, 12, carbon atoms content (average). However, suitable mixtures of ethylene oxide and propylene oxide, sometimes with some butylene oxide, may also be employed as the hydrophile donors. Instead of the higher alcohol, higher alkyl-substituted phenols may be employed, such as those wherein the alkyl is linear and of 7 to 9 carbon atoms. Block copolymers of ethylene oxide (hydrophilic) with propylene oxide and/or butylene oxide (lipophilic) may also be utilized, such as those sold under the trademark Pluronic®, e.g., Pluronics F-68 and L-44. When the nonionic detergent is a condensation product of ethylene oxide and higher fatty alcohl or alkyl phenol there will normally be from 3 to 20 moles of ethylene oxide per mole of nonionic detergent product. Preferably such range will be from 4 to 20 and most preferably from 4 to 15, e.g., 4, 6, 9, 11 or 12. Of course, the number of moles of lower alkylene oxide per mole of detergent is an average because such detergents are made as mixtures.

The cationic surface active agent utilized in the present invention is preferably a quaternary ammonium halide, although analogous phosphonium compounds may be employed under certain circumstances. Various quaternary ammonium halides may be utilized but those which are most satisfactory are those which contain a higher alkyl substituent, preferably accompanied by a plurality of lower alkyl substituents. Thus, it may be of the formula

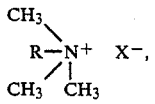

wherein R is a hydrocarbyl chain from 8 to 22 carbon atoms and X is a halogen selected from the group consisting of chlorine and bromine. The higher alkyl, which may be of 10 to 18 carbon atoms, is preferably a single higher alkyl, and three lower alkyls, of 1 to 3 carbon atoms, are also present. Still, in some circumstances one of such lower alkyls may be replaced by another higher alkyl or another lipophilic groups, and sometimes such group may include a plurality of ethoxy groups in a chain. Preferred higher alkyls are those of 12 to 16 carbon atoms, and the preferred lower alkyl is methyl. While all halogens may be used to make quaternary ammonium halides, normally employment of the fluoride and iodide will be avoided and the chlorides and bromides will be most effective. The following are representative of some of the preferred quaternary ammonium halides employed: myristyl trimethylammonium bromide, lauryl trimethylammonium bromide, cetyl trimethylammonium bromide, myristyl trimethylammonium chloride, lauryl trimethylammonium chloride and cetyl trimethylammonium chloride. Dimyristyl dimethylammonium bromide and the corresponding chloride are also operative but preferably the corresponding trimethylammonium derivatives will be used instead.

The $C_{21}$ dicarboxylic acid, which is usually employed in the form of its alkali metal, ammonium or lower (2 to 3 carbon atoms alkyl) alkanolamine salt, preferably a di-salt of sodium, potassium, ammonia or triethanolamine, is a cycloaliphatic dicarboxylic acid of the structure:

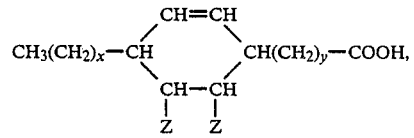

wherein x and y are integers from 3 to 9, x and y together equal 12, and wherein one Z is hydrogen and the other is a carboxylic acid group. The isomers wherein x is 5 and y is 7 form a preponderance of the acid composition but there are also present minor amounts of the $C_{21}$ dicarboxylic acid wherein the cyclohexene ring varies in position along the carbon chain, and minor amounts of dicarboxylic acids of other molecular weights. Typically, the $C_{21}$ dicarboxylic acid is of a molecular weight of 352.5, a saponification number of 312, a refractive index at 25° C. of 1.485, and a density at 25° C. of 1.024 g./ml. The $C_{21}$ dicarboxylic acid, the salts thereof, the physical characteristics thereof and methods for manufacturing it are described in U.S. Pat. No. 3,956,161, which is hereby incorporated by reference. The $C_{21}$ dicarboxylic salts are made by neutralizing the $C_{21}$ dicarboxylic acid with a suitable neutralizing agent, such as ammonia, triethanolamine, diethanolamine, sodium hydroxide or potassium carbonate, and the products of such neutralization may be the corresponding mono- and/or di-salts. Of these, it is considered that the di-salts are best in the present compositions and processes, but in some cases the mono-salts are operative too, and mixtures are also useful.

The final required component of the present compositions is an aqueous medium. Such medium will comprise water, preferably as a major component thereof, and may also include other liquid solvents, such as: lower alcohols, e.g., ethanol; lower glycols, e.g., ethylene glycol, propylene glycol; and lower alkyl ethers of lower glycols, e.g., Cellosolves. Such co-solvents, in addition to helping to solubilize various components of the liquid detergent composition, and improving product homogeneity, may also serve as anti-freezes, preventing solidification of the detergent composition in cold weather.

The water in the present liquid detergents is preferably deionized water but other soft waters, and even tap waters, may be employed. However, usually it will be desirable to keep the water hardness below 150 p.p.m., preferably below 100 p.p.m. and more preferably below 50 p.p.m., as calcium carbonate. If ethanol is utilized it will normally be denatured, e.g., SDA 40.

With the "active" and aqueous medium components mentioned above there may also be included various other materials for improving physical properties of the liquid detergent and for producing special washing effects. Such adjuvants include: thickeners, e.g., carrageenan; foaming agents, e.g., lauric myristic diethanolamide; opalescing and pealescing agents; antibacterial materials, e.g., trichlorocarbanilide; colorants, such as dyes and pigments; antifoams, such as dimethyl silicone; enzymes, such as proteases and amylases; and perfumes. It may also sometimes be desirable to include ionizable inorganic salts, which have been found useful to improve detergency of the present detergent compositions. Sometimes the presence of such ionizable salts in the present liquid detergents can destabilize the detergent, and in such instances it will often be desirable to employ enzymes instead of such builder salts to increase detergency. The enzyme or enzymes will be chosen to break down particular soils present on dishes, which are largely fats, proteins and starches.

The proportions in the present detergent compositions of the nonionic detergent, cationic surface active agent, $C_{21}$ dicarboxylic salt, and aqueous medium are usually from 5 to 25 parts of nonionic detergent, 5 to 25 parts of cationic surface active agent, and 0.5 to 10 parts of $C_{21}$ dicarboxylic salt, and preferably the ratio of nonionic detergent : cationic surface active agent (surfactant) will be in the range of 4:1 to 1:2. For better detergency the $C_{21}$ dicarboxylic salt will be from 3 to 15%, more preferably 5 to 12% of the sum of the nonionic detergent and cationic surfactant. Although the percentages given are preferred, one may also make more dilute detergent compositions, and employ more of them in the dishpan. Thus, concentrations of the nonionic detergent and cationic surfactant as low as 0.5%, with the $C_{21}$ dicarboxylate concentration at 0.1% have proven useful (especially when sodium tripolyphosphate is present in a concentration of 2 to 10% (it helps to remove "dried on" fats). With such compositions concentrations of 5 to 25% may be employed, and sponge application may be desirably practical.

The proportions given above will also set the proportions of the recited components in the wash water. Such wash water solution of detergent composition components is preferably made by dissolving the detergent composition in the water, but alternatively, such components may be added to the water or the water may be added to them. In either case the result is improved detergency with respect to the removal of fatty deposits from the dishes, especially when they are washed in dishwater at room temperature or lower. Although the primary utility of the present liquid detergent compositions is in quickly and effectively removing fatty deposits from hard surfaced substrates, using cold water, such improved detergency is also obtained with respect to oily, gummy, proteinaceous, starchyand sticky deposits and soils. Handwashing with cold dishwaters containing the components of the present compositions quickly and effectively removes all the usual food residues from dishes and cooking utensils and the invented product is superior in this respect to commercial liquid hand dishwashing compositions, especially for the removals of hamburger grease, beef fat, lard, butter, margarine, mayonnaise, and other fatty and oily foods. Another significant advantage of the invention is the antibacterial action of the quaternary salt, which is especially important for a product intended for cold water washing. Additionally, the cationic component helps to prevent any bacterial growths from developing in the detergent composition during lengthy storages in opened containers.

The liquid detergent compositions of this invention will preferably comprise from 10 to 22% of nonionic detergent, 10 to 22% of cationic surface active agent, 1 to 6% of water soluble $C_{21}$ dicarboxylic salt, and 50 to 80% of aqueous medium, often 70% there of or more of water and sometimes entirely of water. Adjuvants for such compositions may make up any balances, to 100%. Usually the total proportion of adjuvant(s) will be limited to 20% and often will be in the range of 1 to 10%. Individual adjuvants will usually be 0.1 to 5% of the composition, if present. More preferred percentages of the required components are 12 to 18, 12 to 18, 2 to 4 and 60 to 75, respectively, with most preferred proportions being about 18%, 18%, 4% and 60%, respectively.

When dishes are washed with the invented compositions (or with the components thereof in the described proportions) the concentration of the composition (or total of the components) in the dishwater is normally in the range of 0.1 to 10%, preferably 0.3 to 3%, and more preferably, for economy, about 0.5 to 1%, e.g., 0.8%. Such concentrations will often correspond approximately to 0.02 to 1.4%, 0.05 to 0.5%, 0.07 to 0.2%, and 0.1%, respectively, for the nonionic detergent and for the cationic surfactant, and 0.005 to 0.3%, 0.005 to 0.05%, 0.01 to 0.03% and 0.02%, respectively, for the $C_{21}$ dicarboxylic salt, in the dishwater. While the lower concentrations within the above ranges are more frequently used, that is for economic reasons; the more of the product that is employed, the better its performance. Thus, whereas when the liquid detergent is applied to a wet sponge and dishes are wiped with the sponge, concentrations of the detergent that are as high as 10% could be used, for normal dishpan or sink washing of dishes the concentrations will be much lower and can be lower still when long soaking periods are utilized, and when the food remains on the dishes are not difficult to remove (not hard fats). Normally, a combination of soaking and mechanical action will be found to be best for quick and effective dishwashing.

The dishwater will preferably be relatively soft but the invented detergent compositions and the components thereof are capable of effectively washing dishes in hard waters, usually of mixed calcium and magnesium hardness, although hardness is preferably in the 0 to 100 or 150 p.p.m. range. Generally, the hotter (or warmer) the water the better the wash, because warmer water tends to melt and dissolve the deposits, such as fats and greases, better. The compositions of this invention are also useful for hot water dishwashing but are especially useful for room temperature or cold water dishwashing because, without the need for melting the fatty or greasy materials on the dishes, the combination of active components of this invention significantly promotes the release of such deposits during washing in room temperature or cold dishwater. This action is attributable to a unique combination of "undermining" and "rolling up" actions of the composition, which loosens and removes the fat from the substrate, and an emulsification action, due to which the fat is moved away from the dishwaterdish interface. While higher water temperatures up to boiling may be employed, if feasible, normal dishwashing temperatures will be in the range of 35° to 50° C. The present detergent compositions (and the components thereof) result in satisfactory removal from dishes of usually very difficult to remove fatty deposits and smears at lower temperatures, such as those in the range of 10 to 40° C. While cleaning is not as good in the lower part of this range as in the upper part, it is feasible to conduct the dishwashing at temperatures in the range of 10 to 20° C., with the results obtainable being comparable to those obtained when washing at higher recommended temperatures with conventional commercial liquid dishwashing detergents intended for hand dishwashing. It is preferred that the dishwater be at a temperature in the ranges of 20° to 35° C. or 20° to 25° C., e.g., 30° C. and 23° C., for best "room temperature" dishwashing, in which significant improvements in fat removal are obtained, compared to control commercial detergent compositions.

The following examples illustrate but do not limit the invention. All parts in the examples and in the specification and claims are by weight and temperatures are in ° C., unless otherwise indicated.

EXAMPLE 1

EXAMPLE 1

| Component | Percent |
|---|---|
| Nonionic detergent[1] | 14.2 |
| Cationic surfactant[2] | 14.2 |
| $C_{21}$ dicarboxylate[3] | 2.8 |
| Water, deionized | 68.8 |
| | 100.0 |

[1]Neodol 23-6.5 (condensation product of 6.5 moles of ethylene oxide with one mole of higher fatty alcohol averaging 12 to 13 carbon atoms)
[2]Tallowalkyl trimethylammonium chloride
[3]Di-triethanolamine salt of Diacid 1550 (Westvaco Corp.)

Equal proportions of hamburger grease are smeared onto upper surfaces of each of four identical circular stainless steel planchets and the planchets are each placed, coated side up, in identical different beakers containing different dishwaters in which there are present 1% of different dishwashing liquid compositions. The dishwashing liquids employed are three commercial liquid dishwashing detergent and the invented liquid dishwashing composition of this example. The three commercial products are Palmolive (beaker No. 1), Dawn (beaker No. 2) and Ajax (beaker No. 3), and the experimental composition is in beaker No. 4. The dishwaters are at 25° C.

After soaking of the planchets for one hour the dishwaters are compared for cloudiness, which is indicative of the amount of hamburger grease removed from the planchets and suspended or emulsified in the dishwater. By visual comparison it is found that the water in beaker No. 4 is definitely cloudier than the waters in the other three beakers. Also, visual examination of the planchets indicates that more hamburger grease was removed from the planchet in beaker No. 4.

Similar results are obtainable when the dishwater is at 20° C. and when, instead of hamburger grease, beef fat or lard is employed as the fatty material on the planchets.

When the experiment is repeated, with beef fat on ceramic plates, essentially the same results are obtained. Also, when instead of soaking for one hour without the application of mechanical energy to the plates, the plates are soaked for five minutes and then lightly hand sponged, the "experimental" product is found to be superior to the commercial products in removing the beef fat at 20° C. and at 25° C., and essentially all of the fat is removed in such experiments when the experimental product is employed. When the commercial products are used the plates are still greasy. Such results are also obtainable when the concentration of the liquid detergents is 0.1%, 0.15% and 0.2%, when the 5-minute soak, followed by light sponging, is employed, and in some cases, when only sponging or wiping with a sponge or cloth soaked in dishwater is practiced.

Results like those described above are also obtainable when the experimental product contains from 5 to 25% of nonionic detergent, 5 to 25% of cationic surfactant, 0.5 to 5% of $C_{21}$ dicarboxylate, and 45 to 89.5% of aqueous medium, of which at least half, or a major proportion, is water.

Also, when instead of the triethanolamine salt of the $C_{21}$ dicarboxylic acid, other salts thereof, such as the ammonium salt and the lower alkylamine salts, e.g., the mono-, di-, and tri-ethylamine salts or other such salts wherein the lower alkyl is of 1 to 3 carbon atoms are employed, similar good results will be obtained. When the alkali metal (sodium and potassium) salts of the $C_{21}$ dicarboxylic acid are employed the results are still good but not as favorable as with the ammonium and triethanolamine salts.

In some experiments that have been run soaking tests at concentrations of liquid dishwashing detergent composition above those normally employed have been employed. Use of the soaking test avoids any variations in the applications of mechanical energy to the surfaces being cleaned and it has been found that the soaking test results are similar, relatively, to actual use tests. The employment of higher concentrations of the liquid dishwashing detergent compositions allows obtaining results in less time, and the results are relatively the same as those for actual use tests.

EXAMPLE 2

EXAMPLE 2

| Component | Percent |
|---|---|
| Igepal ® CA-630[4] (GAF Corporation) | 15.0 |
| Myristyl trimethylammonium bromide | 8.0 |
| $C_{21}$ dicarboxylate[5] | 2.0 |
| Water, deionized | 75.0 |
| | 100.0 |

[4]Octyl phenoxypoly(ethyleneoxy) ethanol
[5]Ammonium salt of Diacid 1550, made by ammonium hydroxide neutralization of Diacid 1550, which had been obtained from Westvaco Corp.

The liquid detergent is clear and stable on storage at elevated temperature.

When the experiments of Example 1 are repeated, using this liquid dishwashing detergent composition, essentially the same results are obtained. When the temperature of the dishwater is raised to 50° C. the experimental composition and the three commercial liquid detergent compositions, mentioned in Example 1, all satisfactorily clean the substrates of the fatty deposits, in both the sponging and soaking tests.

The soaking test results are verified by utilizing scales, which measure the losses in weights of the planchets and dishes during the soaking test, due to removals therefrom of the fatty deposits, caused by actions of the liquid detergent compositions in the dishwaters.

EXAMPLE 3

EXAMPLE 3

| Component | Percent |
|---|---|
| Chemal ® DA-4[6] | 18.0 |
| Adogen ® 471[7] | 18.0 |
| $C_{21}$ dicarboxylate[3] | 3.6 |
| Water | 60.4 |

EXAMPLE 3-continued

| Component | Percent |
|---|---|
| | 100.0 |

[6]Condensation product of four moles of ethylene oxide with one mole of higher fatty alcocci of 10 carbon atoms
[7]Octadecyl trimethyl ammonium bromide
[3]Di-triethanolamine salt of Diacid 1550 (Westvaco Corp.)

A clear liquid dishwashing detergent composition of the above formula is made by admixing the components thereof. Then, three grams of such composition are dissolved in water to make 100 milliliters of dishwater at 25° C. Control dishwaters containing equivalent proportions of commercial dishwashing detergents sold under the trademarks DAWN (Procter & Gamble) and PALMOLIVE (Colgate-Palmolive Company) are made, with the proportions employed being such that the active ingredient contents ( organic detergents and surfactants) are the same. Three wire screen squares are prepared with equal weights of lard smeared onto them and they are simultaneously suspended in the dishwaters. The beaker containing the dishwater made with the dishwashing detergent composition of this invention immediately turns cloudy and an observer can note a vigorous action at the lard-solution interface as the lard is being removed from the wire screen and is being emulsified into the dishwater. On the other hand, the control compositions apparently do not significantly remove the lard from the wire screen and there are little or no observable changes in the control dishwaters. The reported test has been shown by other experiments to indicate the relative dishwashing effectiveness of dishwashing compositions, with respect to removal of fatty soils from hard surfaces.

EXAMPLE 4

EXAMPLE 4

| Component | Percent |
|---|---|
| Neodol 23-6.5 | 1.0 |
| Myristyl trimethyl ammonium bromide | 1.0 |
| Ammonium $C_{21}$ dicarboxylate | 0.2 |
| Sodium tripolyphosphate | 4.0 |
| Water, deionized | 93.8 |
| | 100.0 |

A liquid detergent composition of the above formula is made by dissolving the indicated components in the water to produce a clear product. When such product is employed at a concentration of about 10% in dishwater and is sponged onto dishes containing "dried-on" deposits which have been standing overnight, the deposits are readily removed despite the fact that the dishwater is at a temperature as low as 20° C. Normally, for environmental reasons, phosphates will be omitted from the dishwashing compositions of the present invention but it has been found that they help to remove dried on and hardened deposits of fatty materials from dishes and cooking utensils, and accordingly, they may be incorporated in compositions intended for such uses. Also, they do not adversely affect hand dishwashing of dishes and utensils soiled with normal fatty deposits.

EXAMPLE 5

When the proportions of components of the formulas given in Examples 1–4 are varied ±10% and ±25%, while remaining within the ranges set forth in the specification, essentially the same superiority for the compositions of the invention, compared to the commercial products, will be obtained at temperatures from 10° C. up to 35 or 40° C., with the differences being greater at the lower temperatures. Often the concentrations of the present detergent compositions in the dishwater will be at least 0.1%, preferably at least 0.2%, and more preferably at least 0.5% for best detergency but lesser proportions can be used effectively and greater proportions result in better fatty soil removals.

The invention has been described with respect to illustrations and working embodiments thereof but is not to be limited to these because it is evident that one of skill in the art, with the present specification before him, will be able to utilize substitutes and equivalents without departing from the invention.

What is claimed is:

1. A liquid dishwashing detergent composition for hand washing of dishes in cold water which comprises a synthetic organic nonionic detergent, a cationic surface active agent, a water soluble $C_{21}$ dicarboxylic salt and an aqueous medium, with proportions of the first three of such components being such that the combination of nonionic detergent and cationic surface active agent is a detersive proportion for fatty deposits on dishes and that of the $C_{21}$ dicarboxylic salt is sufficient to improve the detersive action in cold water of the combination of nonionic detergent and cationic surface active agent with respect to fatty deposits on dishes being washed, with the proportion of $C_{21}$ dicarboxylic salt being less than the sum of the proportion of nonionic detergent and cationic surface active agent.

2. A dishwashing detergent composition according to claim 1 wherein the $C_{21}$ dicarboxylic salt is the ammonium or di-triethanolamine salt, the cationic surface active agent is a quaternary ammonium salt and the nonionic detergent is a condensation product of a higher fatty alcohol and ethylene oxide, and the proportion of $C_{21}$ dicarboxylic salt is 3 to 15% of the sum of the proportions of nonionic detergent and quaternary ammonium salt.

3. A liquid dishwashing detergent composition according to claim 1 which comprises from 5 to 25 parts of nonionic detergent, 5 to 25 parts of cationic surface active agent, 0.5 to 10 parts of $C_{21}$ dicarboxylic salt and 40 to 100 parts of aqueous medium.

4. A liquid dishwashing detergent composition according to claim 3 wherein the nonionic detergent is a condensation product of a lower alkylene oxide and a higher fatty alcohol or phenol, the cationic surface active agent is a quaternary ammonium halide, the dicarboxyic salt is a salt of a cation selected from the group consisting of sodium, potassium, ammonium, lower alkylamine, and lower alkanolamine, and the aqueous medium includes a major proportion thereof of water.

5. A liquid dishwashing detergent composition according to claim 4 which comprises 10 to 20% of nonionic detergent, which is a condensation product of 3 to 20 moles of ethylene oxide with one mole of higher fatty alcohol of 10 to 16 carbon atoms per mole, 10 to 20% of

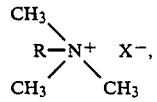

wherein R is a hydrocarbyl chain of 8 to 22 carbon atoms, and X is a halogen selected from the group consisting of chlorine and bromine, 1 to 5% of salt of $C_{21}$ diacid, selected from the group consisting of sodium, potassium, ammonium and triethanolamine salts, and mixtures thereof, and 50 to 80% of water.

6. A liquid dishwashing detergent composition according to claim 5 which comprises about 18% of nonionic detergent which is a condensation product of 4 to 7 moles of ethylene oxide and a mole of higher fatty alcohol of 10 to 13 carbon atoms, about 18% of tallow-alkyl trimethyl ammonium chloride, about 4% of triethanolamine salt of $C_{21}$ diacid and about 60% of water.

7. A process for cold water washing of dishes to remove fatty deposits from surfaces thereof which comprises washing said dishes in dishwater at a temperature in the range of 10° to 40° C., in which dishwater there is present a detergent composition in accordance with claim 3, at a concentration of at least 0.1%.

8. A process for cold water washing of dishes to remove fatty deposits from surfaces thereof which comprises washing said dishes in dishwater at a temperature in the range of 20° to 35° C., in which dishwater there is present a detergent composition in accordance with claim 5, at a concentration of at least 0.2%.

9. A process for cold water washing of dishes to remove fatty deposits from surfaces thereof which comprises hand washing said dishes in dishwater at about room temperature, 20° to 25° C., in which dishwater there is present a detergent composition in accordance with claim 5, at a concentration of at least 0.5%.

10. A process for washing dishes to remove fatty deposits from the surfaces thereof which comprises washing said dishes in dishwater in which there is present 0.05 to 0.5% of synthetic organic nonionic detergent, 0.05 to 0.5% of cationic surface active agent, and 0.005 to 0.05% of a water soluble $C_{21}$ dicarboxylic salt, with the nonionic detergent and cationic surface active agent being present in a combined proportion which is detersive for fatty deposits on dishes, and the $C_{21}$ dicarboxylic salt being present in a proportion sufficient to improve the detersive action in cold water of the combination of nonionic detergent and cationic surfactant with respect to fatty deposits on dishes being washed.

11. A process according to claim 10 wherein the $C_{21}$ dicarboxylic salt is the ammonium or di-triethanolamine salt, the cationic surface active agent is a quaternary ammonium salt and the nonionic detergent is a condensation product of a higher fatty alcohol and ethylene oxide, and the proportion of $C_{21}$ dicarboxylic salt in the dishwater is 3 to 15% of the sum of the proportions of nonionic detergent and quaternary ammonium salt present therein.

* * * * *